United States Patent [19]

Gulbransen

[11] 4,280,287

[45] Jul. 28, 1981

[54] POCKET FOR AN ATHLETIC SHOE

[76] Inventor: Jerry Gulbransen, 804 Mandana Blvd., Oakland, Calif. 94610

[21] Appl. No.: 41,062

[22] Filed: May 21, 1979

[51] Int. Cl.[3] ..... A43B 23/00; A43B 5/00

[52] U.S. Cl. ..... 36/136; 36/114; 2/DIG. 6

[58] Field of Search ..... 36/136, 132, 114, 129; 2/DIG. 6

[56] References Cited

U.S. PATENT DOCUMENTS

| | | | |
|---|---|---|---|
| 1,100,758 | 6/1914 | McAuslin | 36/136 X |
| 3,114,982 | 12/1963 | McGowan | 36/132 |
| 3,537,108 | 11/1970 | Daniels | 2/DIG. 6 |

FOREIGN PATENT DOCUMENTS

| | | | |
|---|---|---|---|
| 581825 | 8/1959 | Canada | 36/136 |
| 1447044 | 6/1966 | France | 36/136 |
| 302862 | 12/1928 | United Kingdom | 36/136 |

OTHER PUBLICATIONS

Runner's World vol. 13, No. 10, Oct. 1978, p. 180.

*Primary Examiner*—James Kee Chi

*Attorney, Agent, or Firm*—Bielen and Peterson

[57] ABSTRACT

A pocket for an athletic shoe utilizing a flat sheet of material which is fastened to the outer side of the same, rearward of the normal walking crease of the upper. The pocket also contains a closure flap connected to the flat sheet and a closure device which seals the pocket.

6 Claims, 4 Drawing Figures

POCKET FOR AN ATHLETIC SHOE

BACKGROUND OF THE INVENTION

The present invention relates to a novel pocket which is particularly applicable in conjunction with an athletic shoe.

Traditional athletic activity takes place in an athletic facility where the person actively engaging in athletic activities is free to store his or her everyday wear and to change into athletic garb. Recently, many athletic activities such as jogging, tennis, hiking, and the like are separate and apart from structures providing locker space, showers, changing rooms, and the like. It is common practice to change into athletic gear and drive to an area where jogging, hiking, and other activities are best performed. These areas, such as parks, running tracks, public courts, and other such places are generally remote from the participants abode. One who engages in athletic activities of this type is often faced with the problem of storing valuables such as a drivers license, a key to a vehicle or home, money, since many types of athletic clothing have no pockets.

A device for storing valuables while engaging in athletics, preferably on the person, without interference with the athletic activity is desirable and necessary to many persons.

SUMMARY OF THE INVENTION

In accordance with the present invention a novel pocket for use with athletic shoes is provided.

The athletic shoe pocket of the present invention includes a flat sheet of material fastened to the outer side of either the left or right athletic shoe of the user. Such a sheet may be fastened by stitching, rivoting, gluing, and the like, or may be formed integrally with the athletic shoe upper. The sheet of material is mounted behind the normal crease area of an athletic shoe which normally parallels the juncture of the toes with the sole of a human foot. The sheet of material may be waterproofed to protect items which are damaged by water, mud, and other elements commonly encountered by athletic shoes in use. The flat sheet of material forms a compartment having an opening at one end thereof. Such an opening may be placed higher than the remaining part of the compartment. It is desirable to fasten the sheet of material to the upper of an athletic shoe generally parallel to the tongue of the shoe.

The compartment formed by the flat also includes a closure flap which has closure means for sealing the opening of the compartment. Such closure means may include a zipper, Velcro (hook and pile closure), snaps, buttons, or any other means which serves this function.

One embodiment of the invention may form an elongated compartment such that the opening of the same is generally above and upward from the remainder of the sheet of material. Also, in the case where the compartment is to be used for the storage of keys, the compartment may be narrower at the bottom portion than at the upward opening. Again, in certain cases it might be desirable to use the pocket of the present invention only during certain time periods, in which case the sheet of material may be removably fastened to the upper of the shoe. This may be easily accomplished by the use of a Velcro strip about the perimeter of the sheet of material. Of course, the pile portion of the Velcro may be placed in several configurations on the athletic shoe upper such that a single athletic shoe may carry several different pockets on separate occasions of various sizes and shapes.

It may be apparent that a novel and useful pocket for an athletic shoe has been described hereinabove.

It is therefore an object of the present invention to provide a pocket for an athletic shoe which provides athletic participants with a place to store keys, money, I.D. cards, and other valuables while engaging in athletic activities.

It is another object of the present invention to provide a pocket for an athletic shoe which holds valuables tightly and protects the valuables from elements which may tend to damage the same.

It is yet another object of the present invention to provide a pocket for an athletic shoe which may be formed integrally with the athletic shoe or formed to be completely removable therefrom.

It is another object of the present invention to provide a pocket for an athletic shoe which does not interfere with the normal flexure and other movements of the athletic shoe which occur during use by a participant in athletic activities.

It is still another object of the present invention to provide a pocket for an athletic shoe which contains valuables on the exterior portion of the shoe and minimizes the possibility of loss of those valuables during participation in any athletic activities wherein the athletic shoe is employed for the same.

The invention possesses other objects and advantages especially as concerns particular characteristics and features thereof which will become apparent as the specification continues.

For a better understanding of the invention, reference is made to the following detailed description.

DESCRIPTION OF THE PREFERRED EMBODIMENTS

Various aspects of the present invention will evolve from the following detailed description of the preferred embodiment thereof which should be taken in conjunction with the heretofore described drawings.

Figure 1:
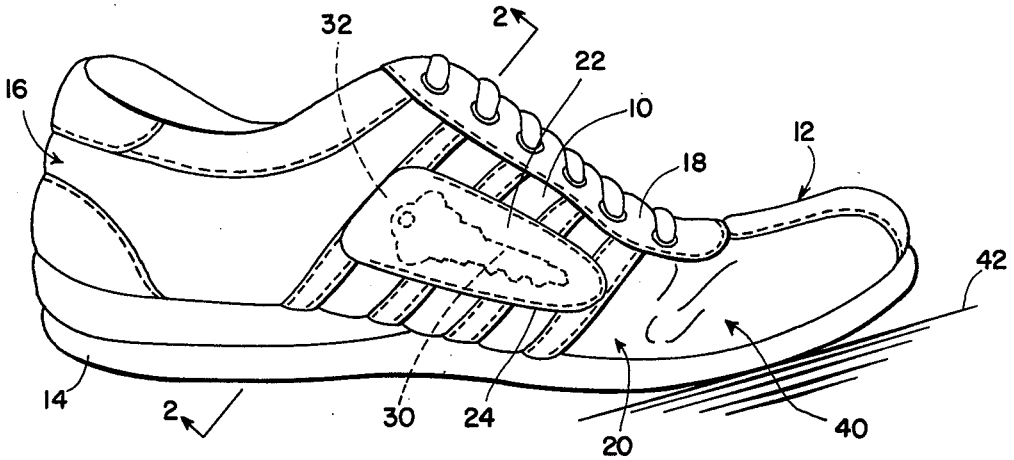
FIG. 1 is a side elevational view depicting the present invention in use.

With reference to FIGS. 1 through 4 the invention as a whole is shown thereon and denoted by reference character 10. Device 10 is generally used in conjunction with an athletic shoe 12. Basically shoe 12 includes a sole 14, upper 16, and lacing area 18. The athletic shoe 12 depicted in FIG. 1 illustrates the outer side 20 of an athletic shoe 12 for the right foot. Of course, the matching left foot shoe (not shown) would have the outer portion on the opposite side.

The device 10 includes a flat sheet of material 22 which is fastened by fastening means to or integrally formed with outer side 20 of athletic shoe 12. As shown in FIG. 1, flat sheet of material 22 is sewn to the upper 16 of athletic shoe 12 above the sole 14 but beneath lacing area 18. As may be seen, stitches 24 extend around three sides of sheet 22 to form a compartment 26 having an opening 28 for insertion of objects such as key 30 between two sides one above the other.

Pocket 10 also includes a closure flap 32 which is formed at the upper end of compartment 26. Closure flap 32 may also include closure means 34 for sealing opening 28 of compartment 26.

Figure 2:
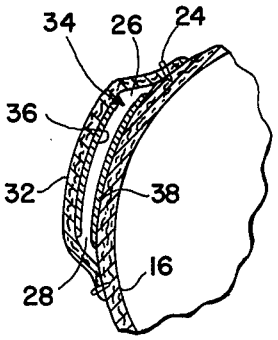
FIG. 2 is a partially broken sectional view taken along line 2—2 of FIG. 1.

Turning to FIG. 2, the preferred embodiment for closure means 34 employs a strip of hook 36 and a strip of pile 38 which engage one another and seal opening 28. For this purpose, Velcro hook and pile closure material may be employed. It should be understood, that many other kinds of closure means may seal opening 28 as snaps, buttons, zippers, and the like.

Pocket 10 is positioned behind the normal crease area 40 which develops during walking or running on surface 42. Moreover, where compartment 26 is elongated closure flap 32 is generally upward from the remaining sheet of material, much like a holster. This mounting method prevents key 30 from escaping from compartment 26 by impacting on closure means 34. Also, compartment 26 may be formed to conform to the outer shape of object or key 30 which greatly reduces movement of the same within compartment 26. Object 30 remains accessible however, since closure flap 32 is easily opened, FIG. 4.

Figure 3:
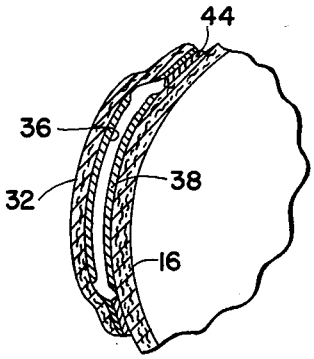
FIG. 3 is a partially broken sectional view showing another embodiment of the present invention.
Figure 4:
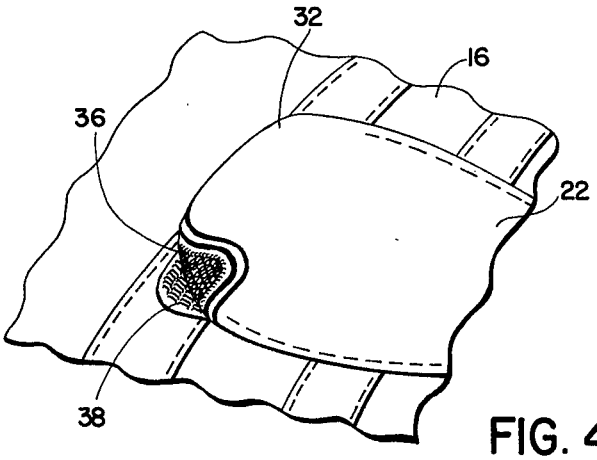
FIG. 4 is an enlarged broken perspective view showing the flat portion of the present invention.

An alternate embodiment of the present invention replaces fastening means for fastening flat sheet 22 to outer side 20 of athletic shoe 12, i.e.: stitches, 24 with a Vercro strip 44, FIG. 3, which may extend around the perimeter of flat sheet 22. Thus, flat sheet 22 is completely removable from upper 16 of athletic shoe 12 in this case. It is anticipated that such an embodiment could provide athletic shoe 12 with the capacity to support several pockets of different sizes and shapes. The user would then determine which pocket to place on upper 16 of athletic shoe 12 depending on what type of objects are to be carried within compartment 26. Also, sheet 22 may be formed of waterproof material such as coated nylon, rubber, and the like to prevent damage to object 30 by water, soil, and other destructive elements.

In operation, the user selects the proper pocket for athletic shoe 12, FIG. 3, and places in upon upper 16 of athletic shoe 12. Object 30 is then placed within compartment 26 and flap 32 is sealed employing closure means 34. The user is then ready to participate in athletic activities after which object 30 is removed by simply reversing the above described process.

The pocket of the present invention provides a solution to storage of valuables while engaging in athletic activities without interference with the same.

While in the foregoing specification embodiments of the present invention have been set forth in considerable detail for the purpose of making a complete disclosure of the invention, it will be apparent to those of ordinary skill in the art that numerous changes may be made in such details without departing from the spirit and principles of the invention.

What is claimed is:

1. A pocket for an athletic shoe comprising:

a. a flat sheet of material including fastening means for removably fastening said entire flat sheet of material to the outer side of an athletic shoe rearward of the normal walking crease of the upper shoe, to form a compartment having an opening located between two sides, one side positioned above the other side, said fastening means comprising hook and pile closure mating elements fastened to the upper of the athletic shoe and generally about the perimeter of the flat sheet of material;

b. a closure flap connected to said flat sheet of material, said closure flap including closure means for sealing said opening of said compartment.

2. The pocket of claim 1 in which said closure means comprises hook and pile closure mating elements fastened to the upper of the athletic shoe and said closure flap.

3. The pocket of claim 2 in which said compartment is elongated and said sheet of material is fastened such that said closure flap is generally upward from said sheet of material.

4. The pocket of claim 3 in which the lower portion of said fastened sheet of material is narrower than the portion of said sheet of material adjacent said closure flap.

5. The pocket of claim 1 in which said closure means comprises hook and pile closure mating elements fastened to the upper of the athletic shoe and said closure flap.

6. The pocket of claim 5 in which said compartment is elongated and said sheet of material is fastened such that said closure flap is generally upward from said sheet of material.

* * * * *